United States Patent [19]

Riegel et al.

[11] 4,037,594

[45] July 26, 1977

[54] EXHAUST REGULATOR VALVE FOR PUSH-PULL DIVING SYSTEM

[75] Inventors: Peter S. Riegel, Columbus; Stephen E. Magill, Circleville; Dwain R. Schroeder, Columbus, all of Ohio

[73] Assignee: The United States of America as represented by the Secretary of the Navy, Washington, D.C.

[21] Appl. No.: 680,320

[22] Filed: Apr. 26, 1976

[51] Int. Cl.[2] ..... A62B 7/00

[52] U.S. Cl. ..... 128/142.3; 137/505.18; 251/DIG. 1; 137/505.41

[58] Field of Search ..... 128/142.3, 142.2, 145.8, 128/202; 137/116.5, 505.42, 505.18, DIG. 8, 494; 251/DIG. 1

[56] References Cited

U.S. PATENT DOCUMENTS

| | | | |
|---|---|---|---|
| 2,663,122 | 12/1953 | Cornelius | 137/505.41 |
| 2,707,966 | 5/1955 | Taplin | 137/505.18 |
| 2,887,123 | 5/1959 | Becker | 137/505.41 |
| 3,968,795 | 7/1976 | O'Neill et al. | 128/142.3 |

FOREIGN PATENT DOCUMENTS

| | | | |
|---|---|---|---|
| 840,559 | 7/1960 | United Kingdom | 251/DIG. 1 |

*Primary Examiner*—Kyle L. Howell
*Assistant Examiner*—Henry J. Recla
*Attorney, Agent, or Firm*—Richard S. Sciascia; Don D. Doty; Harvey A. David

[57] ABSTRACT

A diving helmet exhaust regulator valve maintains helmet pressure substantially constant in a push-pull system wherein breathing gas is supplied under pressure (push) at a constant rate and respired gas is exhausted to a low pressure (pull) conduit for return to a regenerator. The regulator valve is characterized by a throttling valve member operated by a piston that is acted upon by ambient sea pressure and helmet pressure independently of pressures in the upstream exhaust passages, or of exhaust flow rate.

3 Claims, 4 Drawing Figures

EXHAUST REGULATOR VALVE FOR PUSH-PULL DIVING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to diving equipment and more particularly to an improved regulator valve for controlling the pressure in a diving helmet forming part of what is known as a push-pull diving system wherein the exhaust gas, rather than being vented to the water, is sucked back to its source for purification, enrichment, and reuse. Such a regulator is essential to the operation of such a system for, if helmet pressure is not properly controlled, the diver can be exposed to dangerous pneumatic effects. If the pressure gets too high, he may be subject to embolism or pneumothorax. If the pressure gets too low, he may be subjected to a "squeeze," and be physically forced into the helmet by hydrostatic pressure. Both conditions must be avoided.

Moreover, it is most important that the diving apparatus assure the diver the capability of free breathing so as to minimize the actual physical work that the diver must do in order to breath. The diver who must gasp for his air will not be capable of functioning efficiently at his job, nor will he be as physically secure as if he were able to breathe more freely. At greater depths, the breathing gas increases in density and resistance to flow, thereby making it important to provide a regulation valve that minimizes excursions in helmet pressure and concomitantly minimizes the effort expended by the diver in breathing.

DISCUSSION OF THE PRIOR ART

In the more conventional open-circuit diving systems a helmet mounted exhaust regulator generally comprises a spring biased relief valve that establishes a desired pressure differential between the helmet and the surrounding water, with exhaust gas being discharged directly into the water. So too with the semi-closed circuits in which the breathing gas is circulated through a helmet mounted $CO_2$ scrubber, while oxygen rich breathing gas is added to the system from a source of supply and excess gas is discharged or exhausted to the water.

Because of the high cost and logistics problems attendant to the discharge of mixed breathing gases, usually a mixture of helium and oxygen, as exhaust to the water, there have been developed substantially closed, continuous flow systems of the aforementioned push-pull type. Adaptations of existing exhaust valves or regulators have not been wholly satisfactory in their capability of throttling or modulating exhaust to the low pressure return, or pull side, of the system with sufficient sensitivity to avoid substantial pressure excursions in the helmet with the diver's inhalations and exhalations. Moreover, some existing exhaust valves or regulators place the helmet in direct communication with the low pressure return line in the event of diaphragm failure, thereby introducing an added risk of occurrence of diver squeeze. Additionally, some known exhaust regulators are unduly complex and difficult to disassemble for inspection and repair.

SUMMARY OF THE INVENTION

The present invention aims to overcome most or all of the disadvantages of prior art divers exhaust valve regulators for use in push-pull systems through the use of novel constructions that sense the differential in pressure between the helmet and the ambient water medium independently of changes in flow and pressure in the exhaust passages, and through the provision of a throttling valve which is subjected at all times to substantially balanced pressures on opposite sides thereof.

With the foregoing in mind, it is a principal object of this invention to provide an improved divers exhaust regulating valve for push-pull systems.

A more specific object is the provision of an exhaust regulator or valve that variably throttles exhaust gas flow in response to deviations from a selected pressure differential between the associated helmet pressure and the hydrostatic pressure acting thereon, independently of the flow rate or pressure in the valve exhaust passages.

Another object of the invention is the provision, in combination with a diving helmet or mask in a push-pull diving system, of an exhaust regulator that minimizes the excursions of pressure within the helmet or mask so as to reduce the physical work required by the diver to breath.

Yet another object is the provision of a regulator of the foregoing character that requires little effort to function, is relatively fail-safe with respect to diaphragm rupture, and is easily disassembled and reassembled for inspection and repair.

The invention may be further said to reside in certain novel constructions, combinations and arrangements of parts by which the foregoing objects and advantages are achieved, as well as others which will become apparent from the following description of a presently preferred embodiment thereof.

DESCRIPTION OF THE PREFERRED EMBODIMENT

Figure 1:
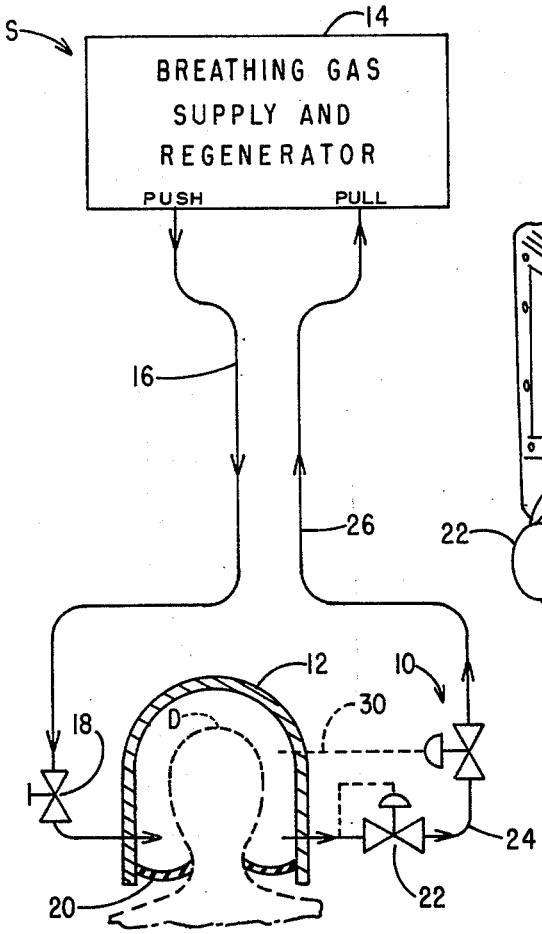
FIG. 1 is a diagrammatic illustration of push-pull diving system incorporating an exhaust regulator valve embodying the invention.

Diver's exhaust regulating valves embodying the present invention are particularly suited for use in diving systems of the continuous flow, push-pull type. Referring to FIG. 1, such a valve is designated generally at 10 and is shown in its association with other elements of a push-pull system S. System S comprises a rigid diving helmet 12 which is supplied with a suitable breathing gas, under pressure (push) from a breathing gas supply and regenerator 14, via a flexible hose 16 and a manually adjustable supply valve 18.

A diver D can control the valve 18 to supply breathing gas at a rate consistent with his needs. Helmet 12 is provided with a neck seal 20, in this instance to exclude water from entering irrespective of the diver's orientation or positional attitude.

Exhaust gas, comprising excess breathing gas in combination with respired breathing gas, is withdrawn from the helmet 12 via a primary or override exhaust valve 22, of conventional exhaust valve construction, which receives gas directly from the helmet and passes it via a conduit 24 to the exhaust regulator valve 10 of this invention. Valve 10 is, in turn, connected to a low pressure or suction line 26 for return (pull) of the exhaust gas to the breathing gas supply and regenerator 14. The breathing gas supply and regenerator 14 may be of well known construction and may be mounted on board ship, for example, or within a submerged personnel transfer capsule which is lowered to and retrieved from a location near the work site with the diver aboard. In such case, the lines 16 and 26 comprise an umbilical between the diver and the capsule whenever the diver is outside thereof. Suffice it to say for purposes of understanding the invention, that the pressure in line 26 is less than that of the ambient pressures in the vicinity of the helmet 12 and the valve 10. Thus, there is a greater differential in pressure between the helmet and the line 26 than between the helmet and the surrounding water.

The exhaust regulator valve 10 is connected, via a passage 30, to sense slight variations in helmet pressure as a result of inhalations and exhalations of the diver, and is responsive thereto, and to the ambient water pressure, to variably throttle or meter the flow of exhaust gas into the suction line 26. The result is that the override exhaust valve 22 sees a low pressure that varies in accordance with the need for maintaining helmet pressure at a desired differential relative to ambient pressures, with a minimum of excursion in helmet pressure, all in a manner which will be made apparent as this specification proceeds.

Figure 2:
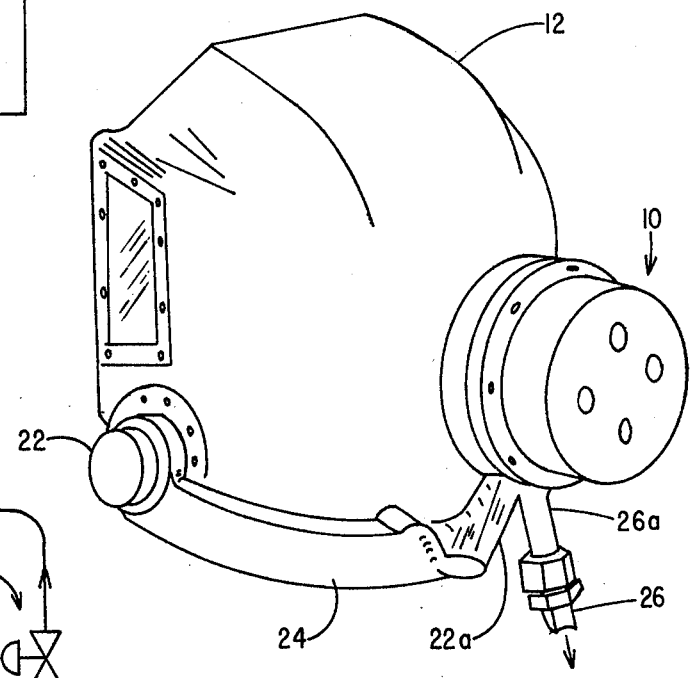
FIG. 2 is a left-rear quarter perspective view illustrating a diving helmet with an exhaust regulator valve, according to the invention, mounted thereon.

Referring to FIG. 2, in a working embodiment of the invention, the exhaust regulator valve 10 is carried on the rear of the helmet 12, while the override exhaust valve 22 is located on the left side thereof. Conduit 24, leading from valve 22 to an inlet connection **22*a*, is conveniently disposed along the lower edge of the helmet. A regulator valve outlet connection 26*a* is connected to suction line 26**.

Figure 3:
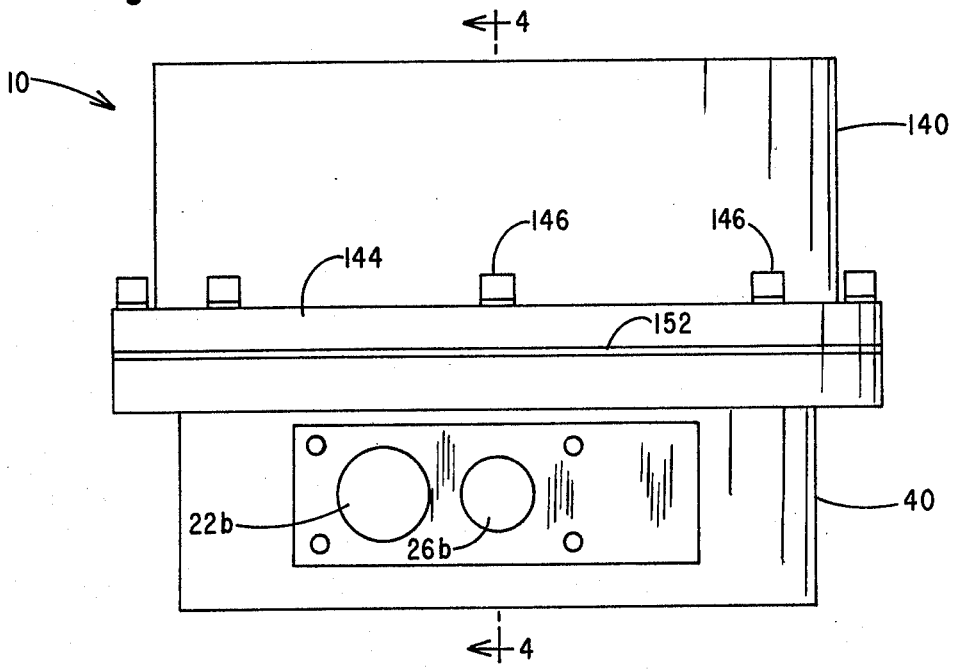
FIG. 3 is a side elevational view of the regulator valve of FIG. 2.
Figure 4:
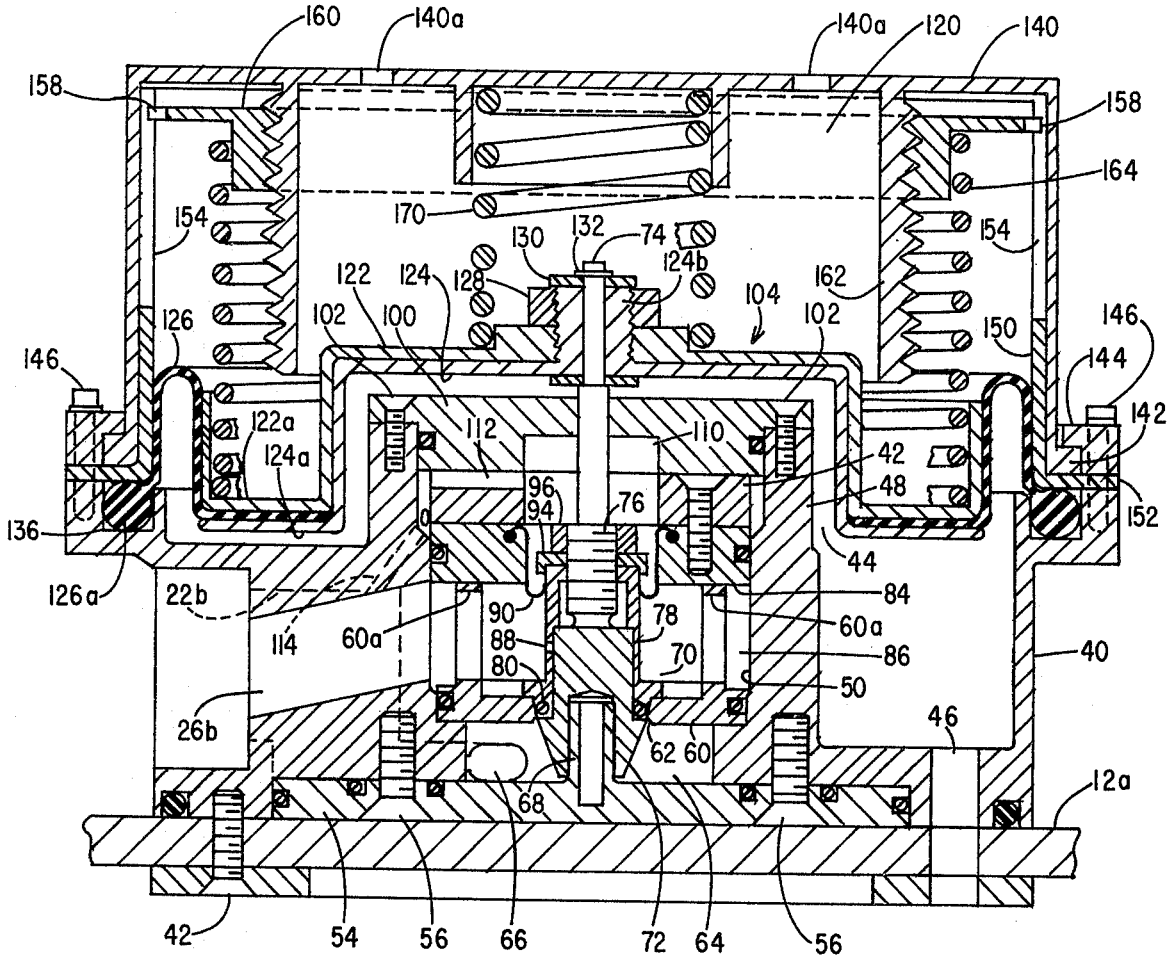
FIG. 4 is a sectional view of the valve, on an enlarged scale, taken substantially along line 4—4 of FIG. 3.

Turning now to FIGS. 3 and 4, valve 10 comprises a generally cylindrical body 40 provided in one side with inlet and outlet ports **22*b* and 26*b* respectively. The valve body 40 is fixed against the helmet wall 12*a*, as by screws 42. Defined in body 40 is an annular helmet pressure sensing chamber 44 that communicates through a passage 46 with the interior of helmet 12. Chamber 44 surrounds an annular boss portion 48 of body 40 having a central, stepped bore 50 extending therethrough. A base plate 54 is recessed into the body 40 and is retained by screws 56. Disposed in the stepped bore 50, against a shoulder thereof, is a valve seat member 60 having a central opening 62. Defined between the plate 54 and the valve seat member 60, is an inlet plenum 64 that communicates via a passage 66 with the inlet port 22*b*. The base plate 54 is further provided with a guide post 68 extending coaxially of bore 50 into opening 62 of the valve seat member 60**.

The guide post 68 acts in guiding relation to a valve member, generally indicated at 70, that is axially reciprocable in opening 62 of the valve seat member 60. Valve member 70 comprises a conical head member 72 having a stem 74 extending axially of bore 50 and including a threaded portion 76. The valve member 70 further comprises a sleeve 78 that cooperates with the conical head member 72 to define a tapered groove in which an elastic O-ring 80 is captivated. The O-ring 80 serves as a pliant seal between the valve seat member 60 and the valve member 70.

Disposed in the bore 50, and resting against spacer elements **60*a* of the valve seat member 60, is an annular plug 84. Between this plug 84 and the valve seat member 60 is defined an exhaust plenum 86 that is in direct communication with the exhaust port 26*b*. The tapered groove for the O-ring 80 is vented at 88 through sleeve 78 to the low pressure in plenum 86 to prevent displacement of that O-ring from its groove. It will be recognized that the valve member 70** controls passage of gas from the inlet plenum to the exhaust plenum.

The valve member 70 is sealed relative to the plug 84 by a flexible, rolling seal member 90, the outer periphery of which comprises a bead recessed into plug 84 and clamped by a ring 92 secured to the plug. The inner edge of the seal member 90 is clamped between the end of sleeve 78 and a washer 94 by a nut 96 on the threaded portion 76 of the valve stem 74. The clamp ring 92, plug 84, and valve seat member 60 are retained in bore 50 by a cover 100 fixed to boss 48 as by screws 102. The valve stem 74 extends through an opening in the cover 100 and is connected at its outer end to a piston, generally indicated at 104.

Defined between the cover 100 and the rolling seal member 90 is a balancing chamber 110 that is connected via passages 112 and 114 to the inlet port **22*b*. It should be noted at this point in the description that the effective area of the rolling seal member 90 and valve member 70 exposed to pressure in the balancing chamber 110 is substantially the same as the area of the valve member 70 exposed to pressure in the inlet plenum 64. Since the inlet plenum and the balancing chamber both communicate with the inlet port 22*b*, it will be seen that forces acting on the valve member due to inlet gas pressures are effectively cancelled. Also, it will be seen that the area of the valve member 70 that is subjected to pressures in the outlet plenum 86 in a direction tending to seat the valve member in the opening in valve seat member 60 is offset by the area of the rolling seal member 90 and valve member 70 that is subjected to pressures in that plenum acting in the opposite direction. Accordingly, valve member 70** is always in a substantially balanced condition relative to forces resulting from pressure differentials between the inlet and exhaust plenums, irrespective of changes in those differentials.

The valve member 70 is, however, responsive to changes in pressure differentials between the helmet pressure acting in the helmet pressure sensing chamber on one side of the piston 104 and the ambient water pressure acting in a water pressure sensing chamber 120 on the opposite side of that piston.

The piston 104 comprises first and second cup-shaped piston members 122 and 124 that are nested and comprise flange portions **122*a* and 124*a*, respectively, that clamp the inner edge of an annular, flexible rolling seal member 126. Piston member 124 includes a threaded nipple 124*b*, through which valve stem 74 extends, that extends through piston member 122 and receives a clamping nut 128. A suitable washer 130 and retainer clip 132 secure the assembled piston 104 on the stem 74. The outer or peripheral edge of the rolling seal member 126 comprises a bead 126*a* that is received in a groove 136 in the upper edge of the valve body 40**.

The ambient pressure sensing chamber 120 is defined by a cup-shaped cover member 140 that is rotatably mounted on the valve body 40 and is provided with apertures 140*a* for communication between the exterior and interior thereof. Cover member 140 includes a peripheral flange 142 that is slidable within a retainer ring 144 secured to the valve body 40 by screws 146.

Interposed between the cover member 140 and the valve body 40 is a generally cylindrical member 150 having a flange 152 clamped between ring 144 and body 40, and overlying the rolling seal bead 126*a* in groove 136. Cylindrical member 150 is characterized by a plurality of axial grooves 154 that receive a corresponding plurality of radially extending ears or tabs 158 on an adjustable spring seat 160.

The spring seat 160 is threadedly engaged on a tubular boss 162, conveniently formed as part of cover member 140, and extending concentrically thereof into chamber 120. A compression spring 164 extends between the seat 160 and the piston 104, and serves to bias the piston and associated valve member 70 toward valve seat member 60. This bias tends to close, throttle, or restrict gas flow from the inlet plenum 64 to the exhaust plenum 86. Rotation of the cover member 140 in one direction causes the spring seat 160 to travel down the threaded boss 162 and increases the biasing force of spring 164 on the piston 104. Conversely, rotation of the cover member 140 in the opposite direction decreases the biasing force.

Another compression spring 170 is disposed between the cover member 140 and the piston 104, and serves to provide a fixed biasing force against the piston 104. The combined biasing forces of springs 164 and 170 establish the pressure differential that is to be maintained between the helmet pressure and the ambient or water pressure. This differential can be manually selectively varied by the diver by the described rotation of the cover member 140.

In the operation of the exhaust regulator valve 10 in the diving system S, consider the valve member 70 to be in an initially closed condition. The manual supply valve 18 is opened to admit a flow of breathing gas from pressure line 16 into the helmet 12. The pressure in helmet 12, and in the helmet pressure sensing chamber 44 will increase until it exceeds the pressure in chamber 120 by such an amount that the force exerted on piston 104 by springs 164 and 170 is just overcome. Thereafter, further increases in helmet pressure will cause the piston 104 to move against the spring and ambient pressure until valve member 70 is carried to an opened position relative to the valve seat member 60 such that helmet gas is vented via the inlet port 22*b,* the plenum chamber 64, the exhaust plenum chamber 86, and the outlet port 26*b* to the exhaust or low pressure line 26. The valve member 70 will then be modulated in position so that the valve 10 will be responsive to all changes in helmet to ambient pressure differential to variably throttle or restrict exhaust gas flow to the low pressure line 26 so that differential is maintained substantially constant. Moreover, the valve 10 will do so irrespective of changes in helmet supply rate, changes in ambient pressure, or changes in suction level in the low pressure line 26.

Thus, when the diver requires more ventilation and admits breathing gas at a greater rate through the supply valve 18, valve 10 will pass exhaust gas to line 26 at a correspondingly greater rate. Superimposed on the basic rate of flow passed to line 26 will be modulations of exhaust flow rate in response to the breathing activity of the diver, thereby minimizing his pulmonary effort.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. Push-pull diving apparatus including a helmet, pressure and suction lines for supplying breathing gas to said helmet from a source and returning exhaust gas to said source, and an exhaust regulator valve mounted on said helmet, said exhaust valve comprising:

a valve body in which are defined an inlet plenum, a balancing chamber, an outlet plenum disposed between said inlet plenum and said balancing chamber, and a valve seat surrounding a flow passage between said plenums, said inlet plenum being connected to receive exhaust gas from said helmet, said outlet plenum being connected to said suction line, and said balancing chamber being in communication with said inlet plenum;

said body further defining a helmet pressure sensing chamber, said helmet pressure sensing chamber being in communication with the interior of said helmet;

a piston having one side exposed to ambient pressure, the other side exposed to said helmet pressure sensing chamber, and movable in response to changes in differential between said helmet and ambient pressures;

a throttling valve member having a stem portion extending through said balancing chamber and connected to said piston for movement thereby in both closing and opening directions relative to said seat for increasing or decreasing throttling of exhaust gas flow from said inlet plenum to said outlet plenum;

said valve member having substantially equal areas exposed to said inlet plenum and to said balancing chamber, whereby forces acting on said valve member due to pressure differentials between said inlet and outlet plenums are substantially cancelled by forces acting on said valve member due to similar pressure differentials between said balancing chamber and said outlet plenum;

load means, acting on said piston, for effecting a predetermined force thereon in said valve member closing direction, whereby said regulating valve is operative to variably restrict exhaust gas flow from said inlet plenum to said outlet plenum so as to maintain pressure in said helmet at a predetermined differential relative to said ambient pressure irrespective of changes in said ambient pressure and in said pressure differential between said inlet and outlet plenums; a cup-shaped cover having a cylindrical outer wall and mounted on said body for rotation about its axis;

said cover comprising an externally threaded tubular boss in spaced concentric relation within said cylindrical outer wall;

an annular first spring seat threadedly engaged on said tubular boss and presenting a plurality of radially extending lugs;

a cylindrical guide member mounted on said body concentrically within said cover, and having axial slots engaged by said lugs so as to prevent rotation of said first spring seat about said axis;

said load means comprising concentric first and second compression springs, said first compression spring being disposed between said cylindrical outer wall and said tubular boss and compressed between said first spring seat and said piston, and said second compression spring being disposed within said tubular boss and compressed between said cover and said piston, whereby upon rotation of said cover in one direction or the other about said axis said first spring seat is moved axially along said tubular boss to vary the length of said first compression spring while maintaining the length of said second compression spring substantially constant.

2. Apparatus as defined in claim 1, and wherein said regulator valve is further characterized by said valve member comprising:

a conical valve head mounted on said stem portion;

a sleeve disposed on said stem portion so as to define a tapered groove between said sleeve and said head portion;

an O-ring seated in said groove; and said groove being vented through said sleeve to said outlet plenum, so that a low pressure is maintained in said groove behind said O-ring relative to pressure in said inlet plenum.

3. Apparatus as defined in claim 1, and wherein said regulator valve is further characterized by said valve member comprising:

a conical valve head mounted on said stem portion;

a sleeve disposed on said stem portion so as to define a tapered groove between said sleeve and said head portion;

an O-ring seated in said groove; and said groove being vented through said sleeve to said outlet plenum, so that a low pressure is maintained in said groove behind said O-ring relative to pressure in said inlet plenum.

* * * * *